US009711872B2

(12) United States Patent
Sato

(10) Patent No.: US 9,711,872 B2
(45) Date of Patent: Jul. 18, 2017

(54) CRIMP TERMINAL AND STRUCTURE FOR CONNECTING CRIMP TERMINAL AND WIRE

(71) Applicant: Yazaki Corporation, Tokyo (JP)

(72) Inventor: Kei Sato, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/255,463

(22) Filed: Sep. 2, 2016

(65) Prior Publication Data

US 2016/0372841 A1 Dec. 22, 2016

Related U.S. Application Data

(63) Continuation of application No. PCT/JP2015/058766, filed on Mar. 23, 2015.

(30) Foreign Application Priority Data

Apr. 4, 2014 (JP) ..... 2014-077645

(51) Int. Cl.
*H01R 4/18* (2006.01)
*H01R 13/52* (2006.01)
*H01R 4/70* (2006.01)

(52) U.S. Cl.
CPC ..... *H01R 4/185* (2013.01); *H01R 4/70* (2013.01); *H01R 13/52* (2013.01); *H01R 13/521* (2013.01)

(58) Field of Classification Search
CPC ..... H01R 4/185; H01R 4/184; H01R 4/188; H01R 4/203; H01R 9/0518; H01R 13/5818

(Continued)

(56) References Cited

U.S. PATENT DOCUMENTS 2,759,163 A * 8/1956 Ustin ..... H01R 4/185 439/825
8,905,799 B2 * 12/2014 Endo ..... H01R 4/185 439/442

(Continued)

FOREIGN PATENT DOCUMENTS

EP 2 871 718 A1 5/2015
JP 2011-198655 A 10/2011

(Continued)

OTHER PUBLICATIONS

International Search Report for PCT/JP2015/058766 dated Jun. 9, 2015 [PCT/ISA/210].

*Primary Examiner* — Harshad Patel
(74) *Attorney, Agent, or Firm* — Sughrue Mion, PLLC

(57) ABSTRACT

A crimp terminal includes a wire connector that crimps a conductor crimping portion and a coating crimping portion in such a manner as to enclose a range continuous from the front end of the conductor crimping portion to the rear end of the coating crimping portion; and a wire holding portion that is formed integrally with the coating crimping portion on the side opposite to the conductor crimping portion via a junction portion and holds the electric wire from the outer circumference of the coating. The junction portion is integrally formed in a manner continuous with a bottom plate of the coating crimping portion. On the inner surface of the junction portion, a convex portion is provided in a protruding manner for crimping the wire connector to the electric wire and bending the electric wire.

4 Claims, 5 Drawing Sheets

(58) Field of Classification Search
USPC ..... 439/866, 850, 852
See application file for complete search history.

(56) References Cited

U.S. PATENT DOCUMENTS

| | | | | |
|---|---|---|---|---|
| 8,963,006 | B2 * | 2/2015 | Kuwayama ..... | H01R 4/185<br>174/113 A |
| 2010/0105257 | A1 * | 4/2010 | Kumakura ..... | H01R 4/185<br>439/877 |
| 2012/0006596 | A1 * | 1/2012 | Kuwayama ..... | H01R 4/188<br>174/84 C |
| 2012/0329317 | A1 | 12/2012 | Aoki et al. | |
| 2012/0329342 | A1 | 12/2012 | Sato | |

FOREIGN PATENT DOCUMENTS

| | | | |
|---|---|---|---|
| JP | 2011-198705 | A | 10/2011 |
| JP | 2013-062206 | A | 4/2013 |
| WO | 2014/010605 | A1 | 1/2014 |

* cited by examiner

CRIMP TERMINAL AND STRUCTURE FOR CONNECTING CRIMP TERMINAL AND WIRE

CROSS-REFERENCE TO RELATED APPLICATION

This application is a continuation application of International Application PCT/JP2015/058766, filed on Mar. 23, 2015, which claims priority from Japanese Patent Application No. 2014-077645, filed on Apr. 4, 2014, and designating the U.S., the entire contents of which are incorporated herein by reference.

BACKGROUND OF THE INVENTION

1. Field of the Invention

The present invention relates to a crimp terminal and a structure for connecting the crimp terminal and an electric wire.

2. Description of the Related Art

Reduction in the weight of a vehicle has a great influence on improvement of fuel consumption. Currently, reduction in carbon dioxide emission is required, and especially in an electric vehicle and a hybrid vehicle where the amount of wire harnesses used therein is larger than that in a petrol-driven vehicle, it is preferable that an electric wire made of aluminum and an aluminum alloy of lightweight materials be used for a wire harness. However, in an aluminum-made wire made of aluminum or an aluminum alloy being crimped and connected to a crimp terminal made of copper or a copper alloy, when water exists where the electric wire and the crimp terminal contact each other, this water serves as an electrolyte between dissimilar metals. In dissimilar metals such as a copper-made terminal and an aluminum-made conductor, when an electric circuit is formed through an electrolyte, corrosion of a metal having a baser potential (for example, the aluminum conductor) is accelerated due to difference in corrosion potential of the dissimilar metals. In other words, galvanic corrosion occurs.

A terminal has been proposed that is capable of preventing water from entering the inside of a crimping portion after crimping while achieving assured water stop property and high reliability over the long term (see Japanese Patent Application Laid-open No. 2013-62206, for example). As illustrated in FIGS. 9A and 9B, this female crimp terminal (crimp terminal) 501 is crimped in such a manner that a pair of barrel pieces 505 of a crimping portion 503 enclose an electric wire exposed portion 515 of an aluminum core 513 exposed from a coating tip 511 of an insulating coating 509 of an aluminum wire 507 that is an insulated wire. Thereafter, a step part of an overlap 517 formed by overlapping the barrel pieces 505 and a step part of an overlap 521 on the tip end side formed by crimping the front side ends of the barrel pieces 505 to a crimping bottom 519 of the crimping portion 503 are welded by a laser seam welding machine. In this manner, water is prevented from entering the inside of the crimping portion 503 after crimping.

The conventional female crimp terminal 501 disclosed in Japanese Patent Application Laid-open No. 2013-62206, however, has a cylindrical structure in which the crimping portion 503 is welded, causing no space for bending the aluminum wire 507. The female crimp terminal 501 is thus hard to take on such a structure (protruding shape, for example) as to increase the fixing force by bending the aluminum wire 507. Consequently, the female crimp terminal 501 may not be able to ensure sufficient fixing force for the aluminum wire 507. This problem becomes prominent especially for the case where the aluminum wire 507 of small diameter (0.5 sq or less) is used.

SUMMARY OF THE INVENTION

The present invention is made in consideration of the issue mentioned above, and an object of the present invention is to provide a crimp terminal and a structure for connecting the crimp terminal and an electric wire that can ensure sufficient fixing force for the electric wire.

In order to achieve the above mentioned object, a crimp terminal according to one aspect of the present invention includes a wire connector that crimps a conductor crimping portion and a coating crimping portion in such a manner as to enclose a range continuous from a front end of the conductor crimping portion to a rear end of the coating crimping portion, the conductor crimping portion crimping a conductor exposed portion in which a conductor is exposed by removing a coating at a terminal end of an electric wire, the coating crimping portion crimping a part of the coating left at the terminal end of the electric wire; and a wire holding portion that is formed integrally with the coating crimping portion on a side opposite to the conductor crimping portion via a junction portion and holds the electric wire from an outer circumference of the coating, wherein the junction portion is integrally formed in a manner continuous with a bottom plate of the coating crimping portion, and on an inner surface of the junction portion, a convex portion is provided in a protruding manner for crimping the wire connector to the electric wire and bending the electric wire.

According to another aspect of the present invention, it is preferable that the crimp terminal further includes a water-proofing material disposed between the wire connector and the electric wire, wherein the water-proofing material has an opening for bringing the conductor exposed portion into contact with the conductor crimping portion and has such a size as to surround the part of the coating and the conductor exposed portion that are crimped by the wire connector.

In order to achieve the above mentioned object, a structure for connecting a crimp terminal and an electric wire according to still another aspect of the present invention includes an electric wire including a conductor, a coating that covers the conductor, and a conductor exposed portion in which the conductor is exposed by removing the coating at a terminal end; and a crimp terminal in which a wire connector is formed, the wire connector including a conductor crimping portion to which the conductor exposed portion at the terminal end of the electric wire is crimped and a coating crimping portion to which a part of the coating left at the terminal end of the electric wire is crimped, wherein in the wire connector, the conductor crimping portion and the coating crimping portion are crimped to the terminal end of the electric wire in such a manner as to enclose a range continuous from a front end of the conductor crimping portion to a rear end of the coating crimping portion, the crimp terminal further includes a wire holding portion that is formed integrally with the coating crimping portion on a side opposite to the conductor crimping portion via a junction portion and holds the electric wire from an outer circumference of the coating, the junction portion is integrally formed in a manner continuous with a bottom plate of the coating crimping portion, and on an inner surface of the junction portion, a convex portion is provided in a protruding manner for crimping the electric wire to the wire connector and bending the electric wire.

According to still another aspect of the present invention, it is preferable that the structure for connecting a crimp terminal and an electric wire further includes a water-proofing material disposed between the wire connector and the electric wire, wherein the water-proofing material has an opening for bringing the conductor exposed portion into contact with the conductor crimping portion and has such a size as to surround the part of the coating and the conductor exposed portion that are crimped by the wire connector.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of a crimp terminal and a structure for connecting the crimp terminal and an electric wire according to the present invention with reference to the drawings.

Figure 1:
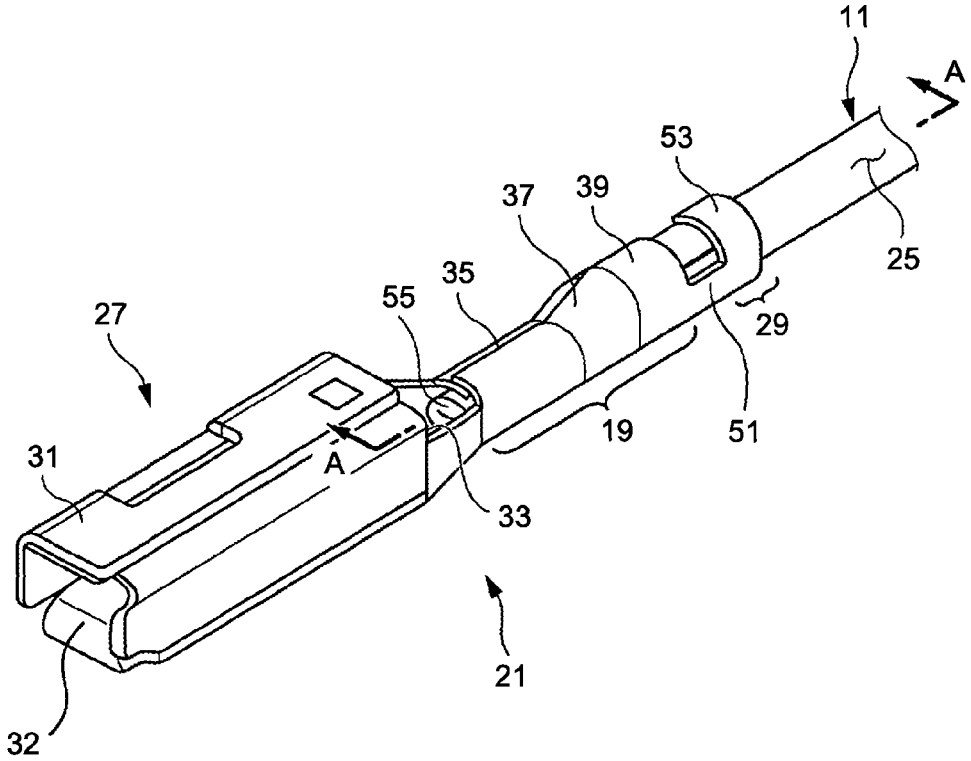
FIG. 1 is a perspective view of a crimp terminal used in a structure for connecting the crimp terminal and an electric wire according to an embodiment of the present invention.
Figure 2:
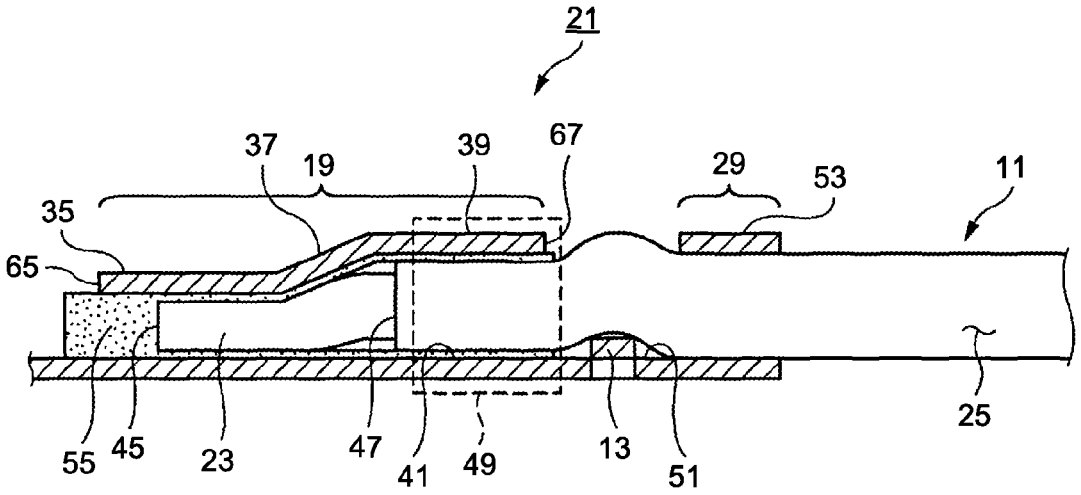
FIG. 2 is a sectional view across A-A in FIG. 1.

As illustrated in FIGS. 1 and 2, the structure for connecting the crimp terminal and an electric wire according to the embodiment of the present invention includes an electric wire 11, a crimp terminal 21, and a water stop sheet 55 that is a water-proofing material.

The electric wire 11 includes a conductor 23 covered with an insulating coating 25. The conductor 23 is formed by twisting together a plurality of element wires. The conductor 23 may be a single wire. For example, aluminum and an aluminum alloy are used for the conductor 23. A synthetic resin is used for the coating 25. Examples of the synthetic resin include a resin formed by adding a flame retardant to a base such as polyvinyl chloride (PVC), polyolefin, and polyamide.

The crimp terminal 21 according to the present embodiment is formed by applying press working (punch working and folding working) to a sheet of metal plate made of a conductive metal (copper and a copper alloy). The crimp terminal 21 is punched while being connected to a carrier (not illustrated) in a chain shape. The crimp terminal 21 is installed on, for example, a connector housing (not illustrated) so as to be used. The crimp terminal 21 includes an electric contact portion 27, a wire connector 19, and a wire holding portion 29 serially from the tip end side (i.e., counterpart terminal side). The electric contact portion 27 electrically contacts a counterpart terminal. The wire connector 19 is connected to the electric wire 11. A box 31 including a spring 32 is formed on the electric contact portion 27. The box 31 receives a tab-shaped conductor connecting portion of a male terminal (not illustrated) serving as a counterpart terminal, and conductively connects the spring 32 to the male terminal. In other words, the crimp terminal 21 is a female terminal.

A lance locking portion 33 is formed on the box 31. When the crimp terminal 21 enters a terminal housing chamber of the connector housing, the lance locking portion 33 is locked to a lance (not illustrated) formed on the connector housing from the rear. In this manner, the crimp terminal 21 is controlled so as not to slip backward off from the terminal housing chamber.

The wire connector 19 includes, on the front side thereof (counterpart terminal side and the electric contact portion 27 side), a conductor crimping portion 35 that is to be crimped to a conductor exposed portion of the electric wire 11. The conductor exposed portion is a part in which the conductor 23 is exposed by removing the coating 25 at the terminal end of the electric wire 11. The wire connector 19 includes, on the rear side of the conductor crimping portion 35 thereof, a coating crimping portion 39 with a connecting portion 37. The coating crimping portion 39 is a part to be crimped to the coating 25 at the terminal end of the electric wire 11. The connecting portion 37 connects the rear end of the conductor crimping portion 35 to the front end of the coating crimping portion 39. The conductor crimping portion 35 and the coating crimping portion 39 have sizes that are based on the diameters of the conductor 23 and the coating 25, respectively.

Figure 6:
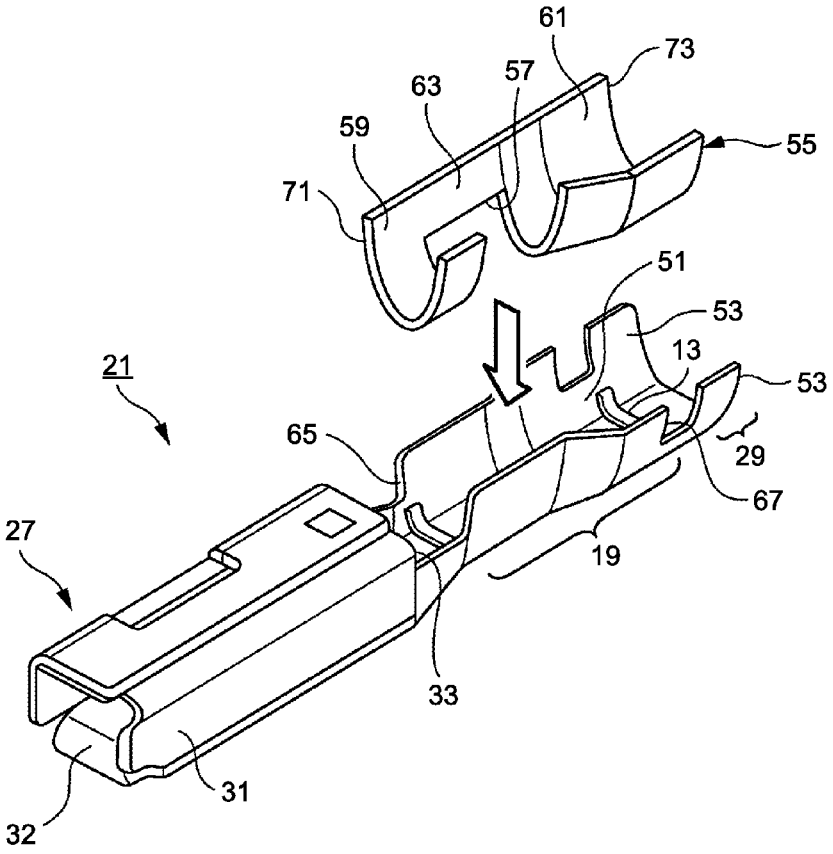
FIG. 6 is an exploded perspective view of the crimp terminal before a water stop material is assembled.

As illustrated in FIG. 2, the conductor crimping portion 35, the connecting portion 37, and the coating crimping portion 39 all share a bottom plate 41. The bottom plate 41 of the wire connector 19 includes swaging pieces 43 provided as a pair on the right and the left sides, and provided standing upwardly from the right and the left edges (see FIG. 7). The swaging pieces 43 are folded inside so as to wrap the conductor 23 and the coating 25 of the electric wire 11, and swage the conductor 23 and the coating 25 held in close contact with the top surface of the bottom plate 41. The wire connector 19 has a U-shaped cross section as illustrated in FIG. 6, being continuous from the front end of the conductor crimping portion 35 to the rear end of the coating crimping portion 39. The wire connector 19 is an integral barrel portion having a length capable of integrally covering a range continuous from a position ahead of a conductor front end 45 (see FIG. 2) to a position behind a coating front end 47 (see FIG. 2) in a configuration in which the wire connector 19 is crimped to the terminal end of the electric wire 11. In other words, the wire connector 19 is crimped in such a manner as to enclose a range continuous from the front end of the conductor crimping portion 35 to the rear end of the coating crimping portion 39. A range from the coating front end 47 to the coating crimping portion 39 is a water stop section 49 in which the coating crimping portion 39 is in close contact with the coating 25.

Furthermore, the wire holding portion 29 is formed in a manner continuous with the wire connector 19. The wire holding portion 29 is integrally formed on the side opposite to the conductor crimping portion 35 of the coating crimping portion 39 via a junction portion 51. The wire holding portion 29 of the present embodiment includes a pair of holding pieces 53 that are integrally formed via the junction portion 51 integrally formed in a manner continuous with the bottom plate 41 of the coating crimping portion 39, and has a U-shaped cross section. The pair of holding pieces 53 in the wire holding portion 29 holds the electric wire 11 from the outer circumference of the coating 25.

The junction portion 51 integrally formed in a manner continuous with the bottom plate 41 of the coating crimping portion 39 has a gutter-shaped semicircular cross section along a part of the outer circumference of the electric wire 11, and integrally connects the wire connector 19 to the wire holding portion 29. As a result, the upper part of the junction portion 51 on which the electric wire 11 derived from the wire connector 19 is to be mounted is an open space. On the inner surface of the junction portion 51, a convex portion 13 is provided in a protruding manner for bending the electric wire 11 along the axial direction of the wire connector 19.

Figure 3A:
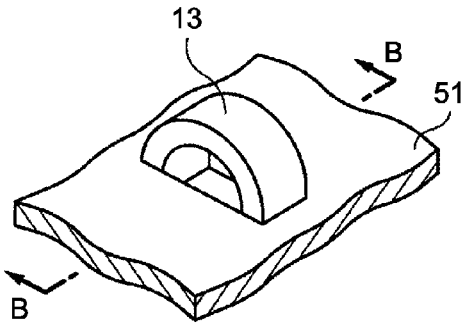
FIG. 3A is a perspective view of a convex portion formed into a semicircular arch in a direction in which the axial line is along the electric wire.
Figure 3B:
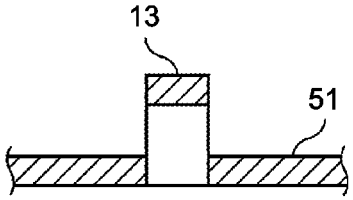
FIG. 3B is a sectional view across B-B in FIG. 3A.
Figure 4A:
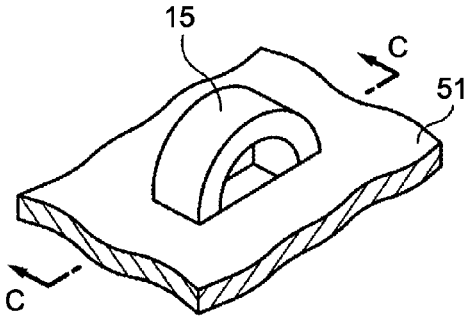
FIG. 4A is a perspective view of a convex portion formed into a semicircular arch in a direction in which the axial line is orthogonal to the electric wire.
Figure 4B:
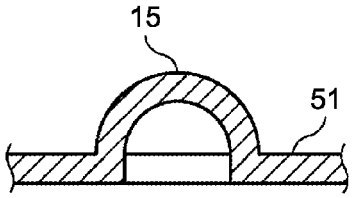
FIG. 4B is a sectional view across C-C in FIG. 4A.
Figure 5A:
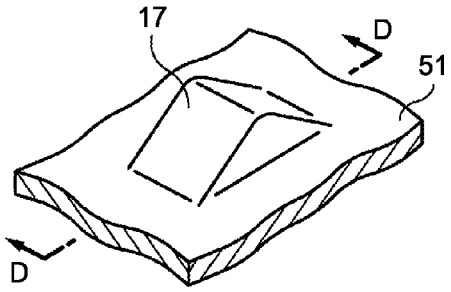
FIG. 5A is a perspective view of a convex portion formed into a ridge shape.
Figure 5B:
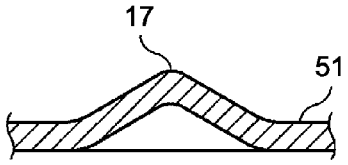
FIG. 5B is a sectional view across D-D in FIG. 5A.

The convex portion 13 according to the present embodiment is formed into a semicircular arch in a direction in which the axial line is along the electric wire 11 as illustrated in FIGS. 3A and 3B. As a result, the electric wire 11 to be mounted on the junction portion 51 is bent into a ridge shape along the convex portion 13 when being swaged and held by the wire connector 19 (see FIG. 2). The convex portion 13 according to the present embodiment may be a convex portion 15 formed into a semicircular arch in a direction in which the axial line is orthogonal to the electric wire 11 as illustrated in FIGS. 4A and 4B. Furthermore, the convex portion 13 according to the present embodiment may be a convex portion 17 formed by being swelled into a ridge shape as illustrated in FIGS. 5A and 5B. The convex portion 13 and the convex portion 15 are formed by cutting and raising work, for example; the convex portion 17 is formed by applying press working and the like.

The structure for connecting the crimp terminal 21 and the electric wire 11 according to the present embodiment includes the water stop sheet 55 that is a water-proofing material as illustrated in FIG. 6. The water stop sheet 55 is made of an insulating material such as a resin material or rubber having some thickness and elasticity. The water stop sheet 55 has an opening 57 for bringing the conductor 23 into contact with the conductor crimping portion 35. The opening 57 according to the present embodiment is formed by punching the water stop sheet 55 into a U-shape. The opening 57 may be, alternatively, a hole with its circumference closed.

The water stop sheet 55 has such a size as to surround the conductor 23 that is to be crimped and the coating 25. The water stop sheet 55 is disposed inside of the wire connector 19 so that the water stop sheet 55 is laid between the wire connector 19 and the electric wire 11. With the wire connector 19 swaged, the water stop sheet 55 encloses and seals the conductor 23 and the coating 25. The water stop sheet 55 can be a double-sided adhesive sheet that is a sheet of the base material both sides of which have an adhesive layer. On each of the adhesive layers of the unused water stop sheet 55, a release sheet is provided via a release layer.

The following describes the steps at which the crimp terminal 21 and the electric wire 11 are connected. As illustrated in FIG. 6, the water stop sheet 55 having the opening 57 is first placed at a position corresponding to the conductor exposed portion on the inner surface of the wire connector 19 having a U-shaped cross section in the crimp terminal 21. The water stop sheet 55 has, on the front side of the opening 57, a front-side sheet portion 59 extending in the width direction (right and left direction) of the wire connector 19, and has, on the rear side of the opening 57, a rear-side sheet portion 61 extending in the width direction of the wire connector 19. The water stop sheet 55 also has a side sheet portion 63 that connects the front-side sheet portion 59 and the rear-side sheet portion 61 along one side (right side) of the opening 57.

In addition, the water stop sheet 55 has such a length that, once the wire connector 19 is crimped to the terminal end of the electric wire 11, a water-proofing material front end 71 and a water-proofing material rear end 73 of the water stop sheet 55 protrude externally from the crimping portion front end (front end) 65 and the crimping portion rear end (rear end) 67 of the wire connector 19, respectively. Specifically, the water stop sheet 55 has such a length that the water-proofing material front end 71 of the front-side sheet portion 59 lies ahead of the crimping portion front end 65 of the conductor crimping portion 35, and the water-proofing material rear end 73 of the rear-side sheet portion 61 lies behind the crimping portion rear end 67 of the coating crimping portion 39. The water stop sheet 55 is then attached to the inside of the wire connector 19 via a coating of an adhesive layer having been exposed by peeling off the release sheet on one side of the water stop sheet 55.

Once the water stop sheet 55 is placed inside of the wire connector 19, the release sheet on the other side of the water stop sheet 55 is peeled off, so that the adhesive layer is exposed, and the terminal end of the electric wire 11 having the coating 25 stripped off (having the coating 25 removed by a certain length) is then placed on the top surface of the bottom plate 41 of the wire connector 19. At this time, the conductor front end 45 of the conductor exposed portion is positioned behind the water-proofing material front end 71 of the water stop sheet 55. The coating front end 47 of the coating 25 is positioned ahead of the water-proofing material rear end 73 of the water stop sheet 55, and ahead of the crimping portion rear end 67 of the wire connector 19.

In this arrangement, the wire connector 19 is crimped to the terminal end of the electric wire 11. In other words, the swaging pieces 43 on the right and the left sides are folded inside in order and swaged so as to wrap the terminal end of the electric wire 11. The tip end of one of the swaging pieces 43 overlaps the tip end of the other swaging piece 43.

By swaging the swaging pieces 43 in this manner, the conductor crimping portion 35 of the crimp terminal 21 and the conductor 23 of the electric wire 11 are electrically connected via the opening 57 formed on the water stop sheet 55. The front side and the rear side of the connected part of the conductor crimping portion 35 and the conductor 23 are sealed by the water stop sheet 55. The water-proofing material front end 71 and the water-proofing material rear end 73 of the water stop sheet 55 protrude externally from the crimping portion front end 65 and the crimping portion rear end 67 of the wire connector 19, respectively, and the structure for connecting the crimp terminal 21 and the electric wire 11 is thus completed.

Figure 7:
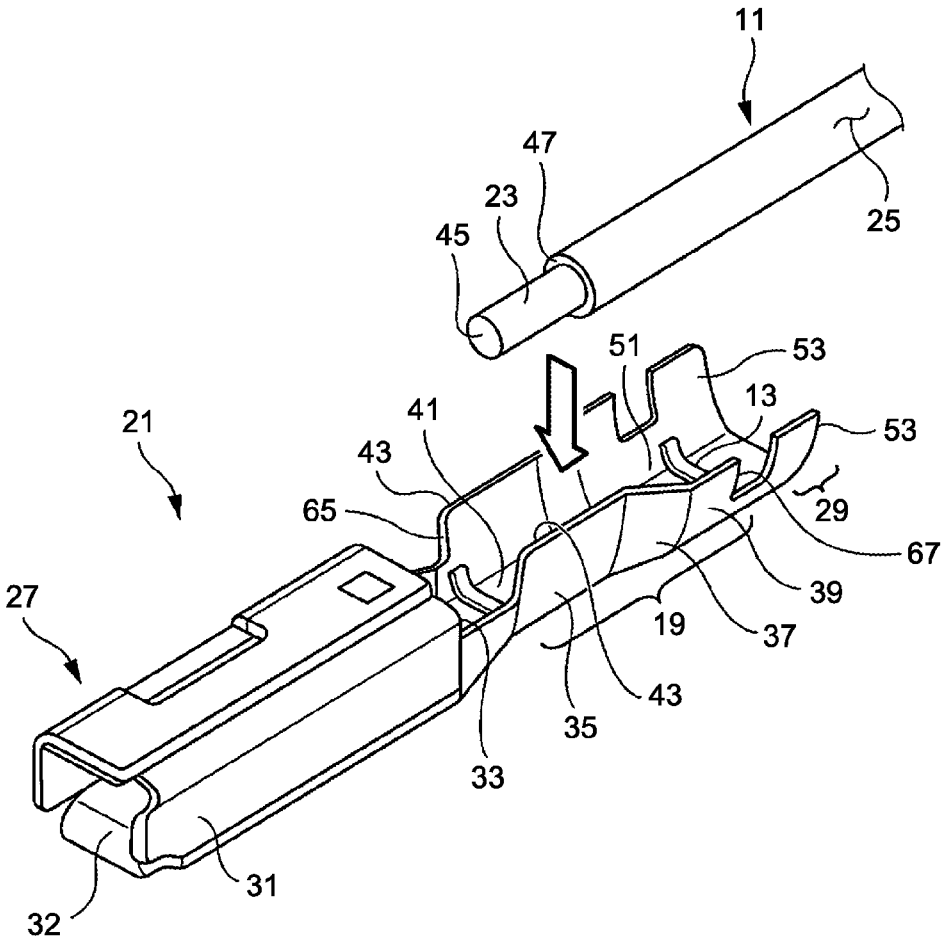
FIG. 7 is an exploded perspective view of the crimp terminal before being crimped to the electric wire without using the water stop material.

Although the structure for connecting the crimp terminal 21 and the electric wire 11 according to the present embodiment described above has been described for the case of using the water stop sheet 55, by squeezing the crimping portion front end 65 instead of using the water stop sheet 55, the conductor front end 45 can be covered that has been exposed inside of the conductor crimping portion 35 before the crimping portion front end 65 was squeezed. As illustrated in FIG. 7, when the structure for connecting the crimp terminal 21 and the electric wire 11 does not use the water stop sheet 55, the electric wire 11 is first placed on the inner surface of the wire connector 19 having a U-shaped cross section in the crimp terminal 21. The terminal end of the electric wire 11 having the coating 25 stripped off (having the coating 25 removed by a certain length) is placed on the top surface of the bottom plate 41 of the wire connector 19. At this time, the conductor front end 45 is positioned behind the crimping portion front end 65. The coating front end 47 of the coating 25 is positioned ahead of the crimping portion rear end 67.

In this arrangement, the wire connector 19 is crimped to the terminal end of the electric wire 11 using a swaging die (not illustrated). In other words, the swaging pieces 43 on the right and the left sides are folded inside in order and swaged so as to wrap the terminal end of the electric wire 11. The tip end of one of the swaging pieces 43 overlaps the tip end of the other swaging piece 43.

Figure 8:
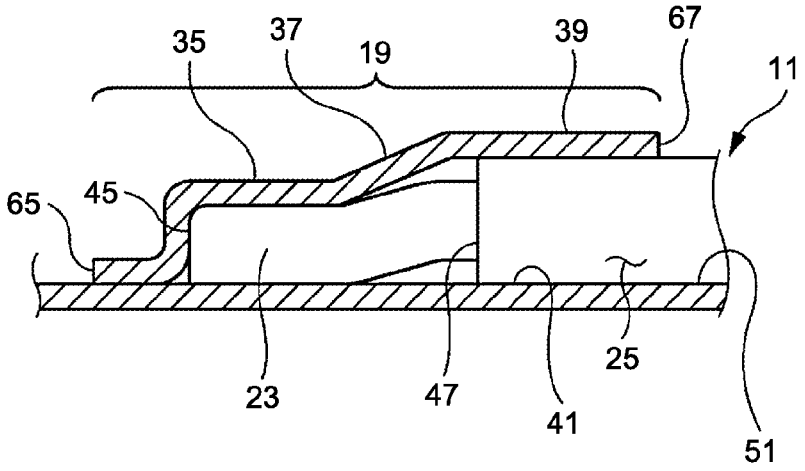
FIG. 8 is a sectional view of a wire connector the tip end of which is squeezed.
Figure 9A:
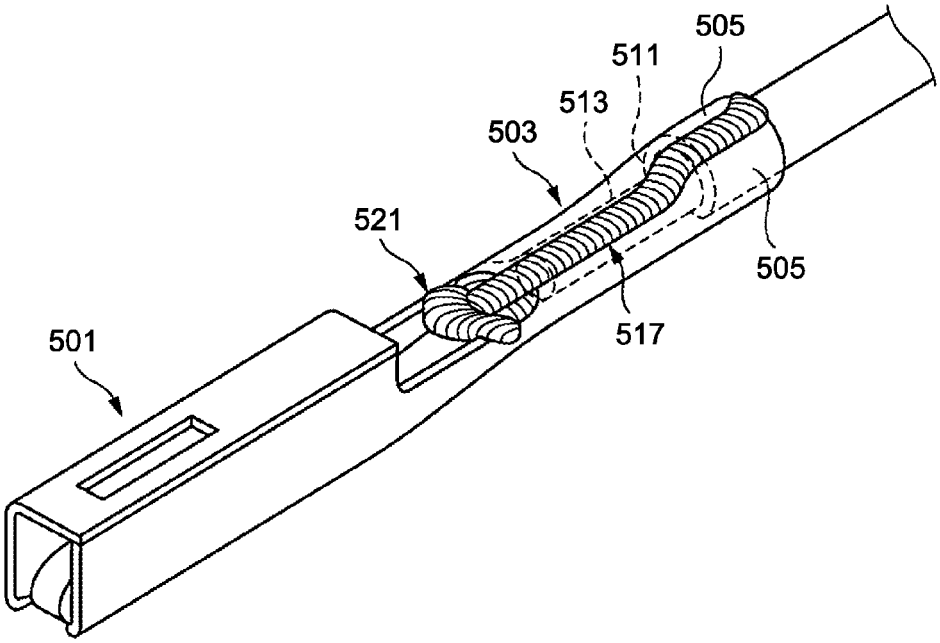
FIG. 9A is a perspective view illustrating a state in which a conventional female crimp terminal and an insulated wire are crimped.
Figure 9B:
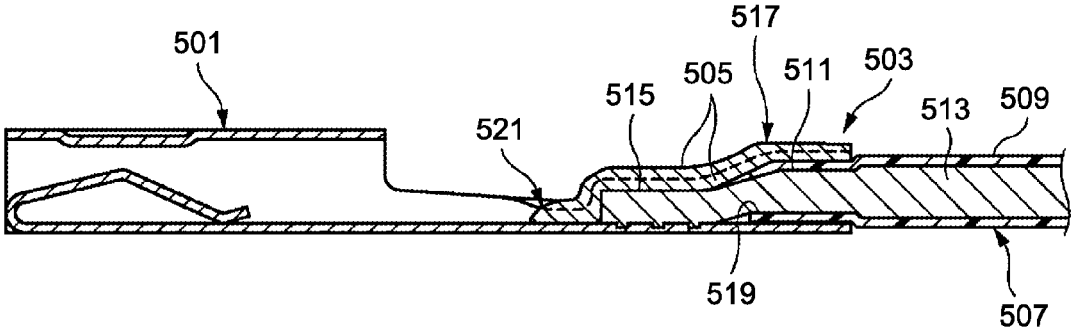
FIG. 9B is a longitudinal sectional side view illustrating the state in which the conventional female crimp terminal and the insulated wire are crimped.

By swaging the swaging pieces 43 in this manner, the conductor crimping portion 35 of the crimp terminal 21 and the conductor 23 of the electric wire 11 are electrically connected. In addition, the coating crimping portion 39 and the coating 25 of the electric wire 11 are fixed. Thereafter, the pair of holding pieces 53 in the wire holding portion 29 are swaged to the electric wire 11, and then the crimping portion front end 65 is further squeezed as illustrated in FIG. 8. In this manner, the conductor front end 45 that has been exposed inside of the conductor crimping portion 35 is covered with the squeezed crimping portion front end 65, and the structure for connecting the crimp terminal 21 and the electric wire 11 is thus completed. The conductor front end 45 that has been exposed inside of the conductor crimping portion 35 may be sealed with the front side of the conductor crimping portion 35 filled with an adhesive or a sealant.

The following describes effects achieved by the crimp terminal 21 and the structure for connecting the crimp terminal 21 and the electric wire 11 having the configuration described above. In the crimp terminal 21 according to the present embodiment, the terminal end of the electric wire 11 having the conductor 23 exposed is enclosed by the wire connector 19 and connected to the crimp terminal 21. The wire connector 19 has the coating 25 of the electric wire 11 swaged and fixed in the coating crimping portion 39 while ensuring continuity between the crimp terminal 21 and the conductor 23 in the conductor crimping portion 35. In this manner, the exposed conductor 23 is enclosed by the wire connector 19, preventing corrosion of the conductor 23 (aluminum wire in which galvanic corrosion tends to occur, in particular). Furthermore, the electric wire 11 derived from the wire connector 19 is held from the outer circumference of the coating 25 also by the wire holding portion 29 formed integrally with the wire connector 19 via the junction portion 51. Because the wire holding portion 29 of the crimp terminal 21 can hold the electric wire 11 independently of the wire connector 19, the crimp terminal 21 can ensure higher fixing force for the electric wire 11 than that of a conventional structure even if an aluminum wire of small diameter is used.

In the crimp terminal 21 according to the present embodiment, the junction portion 51 that connects the wire connector 19 to the wire holding portion 29 is integrally formed in a manner continuous with the bottom plate 41 of the coating crimping portion 39. As a result, the upper part of the junction portion 51 on which the electric wire 11 derived from the wire connector 19 is to be mounted is an open space. The electric wire 11 mounted on the junction portion 51 is bent into a ridge shape by the convex portion 13 of the junction portion 51 when being swaged and held by the wire holding portion 29. In other words, the open space above the junction portion 51 serves as a space for bending the electric wire 11 into a ridge shape. The electric wire 11 that has been bent into a ridge shape by the convex portion 13 and fixed to the wire connector 19 and the wire holding portion 29 is securely fixed to the crimp terminal 21 even if an aluminum wire of small diameter (0.5 sq or less) with low strength is used.

In the structure for connecting the crimp terminal 21 and the electric wire 11 that includes the water stop sheet 55 according to the present embodiment, the wire connector 19 itself is plastically deformed by swaging when the terminal is crimped, thereby plastically deforming the conductor 23 and the coating 25 of the electric wire 11 via the water stop sheet 55. The water stop sheet 55 having caused the conductor 23 and the coating 25 to deform as a result of the wire connector 19 being swaged receives a reactive force of the conductor 23 and the coating 25. The water stop sheet 55 receiving the reactive force is compressed, and is moved across the extra space or the like in the crimped wire connector 19. The deformed water stop sheet 55 is disposed highly densely with no space inside the swaged wire connector 19. As a result, water does not easily enter the inside of the wire connector 19 from the outside. In this manner, no electrolyte is supplied between dissimilar metals. In the crimp terminal 21 and the structure for connecting the crimp terminal 21 and the electric wire 11 according to the present embodiment, galvanic corrosion is therefore prevented that tends to occur in the electric wire 11 made of aluminum or aluminum alloy, for example, that is crimped to the conductor crimping portion 35 made of copper or copper alloy.

When the electric wire 11 is swaged to the wire connector 19 via the water stop sheet 55, the wire connector 19 may slip off the electric wire 11. However, fixing the electric wire 11 by the wire holding portion 29 according to the present embodiment can prevent the slip. In other words, providing the wire holding portion 29 has great effect on improving fixing force in the structure for connecting the crimp terminal 21 and the electric wire 11 that includes the water stop sheet 55, in particular.

The crimp terminal 21 and the structure for connecting the crimp terminal 21 and the electric wire 11 according to the present embodiment can ensure sufficient fixing force.

The present invention is not limited to the embodiment described above, and can be modified or improved, for example, as appropriate. In addition, the material, the shape, the size, the number, the location, and the like of each component in the embodiment described above are optional and not limiting as long as the present invention can be embodied.

The crimp terminal and the structure for connecting the crimp terminal and an electric wire according to the embodiment can ensure sufficient fixing force for the electric wire.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a wire connector that crimps a conductor crimping portion and a coating crimping portion in such a manner as to enclose a range continuous from a front end of the conductor crimping portion to a rear end of the coating crimping portion, the conductor crimping portion crimping a conductor exposed portion in which a conductor is exposed by removing a coating at a terminal end of an electric wire, the coating crimping portion crimping a part of the coating left at the terminal end of the electric wire; and a wire holding portion that is formed integrally with the coating crimping portion on a side opposite to the conductor crimping portion via a junction portion and holds the electric wire from an outer circumference of the coating, wherein the junction portion is integrally formed in a manner continuous with a bottom plate of the coating crimping portion, and on an inner surface of the junction portion, a convex portion is provided in a protruding manner for crimping the wire connector to the electric wire and bending the conductor and the coating of the electrical wire.

2. The crimp terminal according to claim 1, further comprising:

a water-proofing material disposed between the wire connector and the electric wire, wherein the water-proofing material has an opening for bringing the conductor exposed portion into contact with the conductor crimping portion and has such a size as to surround the part of the coating and the conductor exposed portion that are crimped by the wire connector.

3. A structure for connecting a crimp terminal and an electric wire, the structure comprising:

an electric wire including a conductor, a coating that covers the conductor, and a conductor exposed portion in which the conductor is exposed by removing the coating at a terminal end; and a crimp terminal in which a wire connector is formed, the wire connector including a conductor crimping portion to which the conductor exposed portion at the terminal end of the electric wire is crimped and a coating crimping portion to which a part of the coating left at the terminal end of the electric wire is crimped, wherein in the wire connector, the conductor crimping portion and the coating crimping portion are crimped to the terminal end of the electric wire in such a manner as to enclose a range continuous from a front end of the conductor crimping portion to a rear end of the coating crimping portion, the crimp terminal further includes a wire holding portion that is formed integrally with the coating crimping portion on a side opposite to the conductor crimping portion via a junction portion and holds the electric wire from an outer circumference of the coating, the junction portion is integrally formed in a manner continuous with a bottom plate of the coating crimping portion, and on an inner surface of the junction portion, a convex portion is provided in a protruding manner for crimping the electric wire to the wire connector and bending the conductor and the coating of the electrical wire.

4. The structure for connecting a crimp terminal and an electric wire according to claim 3, further comprising:

a water-proofing material disposed between the wire connector and the electric wire, wherein the water-proofing material has an opening for bringing the conductor exposed portion into contact with the conductor crimping portion and has such a size as to surround the part of the coating and the conductor exposed portion that are crimped by the wire connector.

* * * * *